US005242242A

United States Patent [19]

Young

[11] Patent Number: 5,242,242

[45] Date of Patent: Sep. 7, 1993

[54] TRAFFIC CONTROL MARKER APPARATUS

[76] Inventor: James C. Young, 5220 Kauai Way, Fair Oaks, Calif. 95628

[21] Appl. No.: 826,036

[22] Filed: Jan. 27, 1992

[51] Int. Cl.[5] ..... E01F 9/06

[52] U.S. Cl. ..... 404/12; 404/13

[58] Field of Search ..... 404/9, 12, 13, 14, 15, 404/16

[56] References Cited

U.S. PATENT DOCUMENTS 2,136,709 11/1938 Robertson ..... 404/13

4,687,369 8/1987 McDonald ..... 404/12

*Primary Examiner*—William P. Neuder

*Attorney, Agent, or Firm*—Leon Gilden

[57] ABSTRACT

A traffic control marker includes an elongate flexible arrow member arranged for positioning upon a road surface to direct traffic flow therethrough. The marker provides for a removable forward head relative to the marker for use of the arrow head relative to the marker. A modification of the invention includes suction cup members molded into the bottom wall of the marker body and arrow head, as well as reflector housings mounting reflective lenses projecting rearwardly of the marker head, with a further organization to include the reflector housing positioned medially of speed-bump type boss members that in conjunction with the reflector housing are orthogonally oriented relative to the side walls of the body as a one-piece assembly.

1 Claim, 4 Drawing Sheets

TRAFFIC CONTROL MARKER APPARATUS

BACKGROUND OF THE INVENTION

1. Field of the Invention

The field of invention relates to traffic indicator and control structure, and more particularly pertains to a new and improved traffic control marker apparatus wherein the same is arranged for the temporary rerouting and orientation of traffic relative to a roadway.

2. Description of the Prior Art

Lane markers and reflective lane markers of various types have been utilized throughout the prior art, such as exemplified in U.S. Pat. No. 4,284,365 to Rabinow wherein reflective lane markers are mounted within a roadway in a fixed orientation thereto.

U.S. Pat. No. 4,035,059 to Demaster sets forth a raised profiled reflective highway marker mounted on a roadway surface.

U.S. Pat. Nos. 3,964,821 to Eigenmann and 3,924,929 to Holmen, et al. are further examples of reflective articles for use relative to a highway type situation as required.

As such, it may be appreciated that there continues to be a need for a new and improved traffic control marker apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of traffic control apparatus now present in the prior art, the present invention provides a traffic control marker apparatus wherein the same utilizes a flexible polymeric traffic control marker arranged for mounting to a roadway top surface in a temporary manner thereto. As such, the general purpose of the present invention, which will be described subsequently in greater detail, is to provide a new and improved traffic control marker apparatus which has all the advantages of the prior art traffic control apparatus and none of the disadvantages.

To attain this, the present invention provides a traffic control marker including an elongate flexible arrow member arranged for positioning upon a road surface to direct traffic flow therethrough. The marker provides for a removable forward head relative to the marker for use of the arrow head relative to the marker. A modification of the invention includes suction cup members molded into the bottom wall of the marker body and arrow head, as well as reflector housings mounting reflective lenses projecting rearwardly of the marker head, with a further organization to include the reflector housing positioned medially of speed-bump type boss members that in conjunction with the reflector housing are orthogonally oriented relative to the side walls of the body.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved traffic control marker apparatus which has all the advantages of the prior art traffic control apparatus and none of the disadvantages.

It is another object of the present invention to provide a new and improved traffic control marker apparatus which may be easily and efficiently manufactured and marketed.

It is a further object of the present invention to provide a new and improved traffic control marker apparatus which is of a durable and reliable construction.

An even further object of the present invention is to provide a new and improved traffic control marker apparatus which is susceptible of a low cost of manufacture with regard to both materials and labor, and which accordingly is then susceptible of low prices of sale to the consuming public, thereby making such traffic control marker apparatus economically available to the buying public.

Still yet another object of the present invention is to provide a new and improved traffic control marker apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
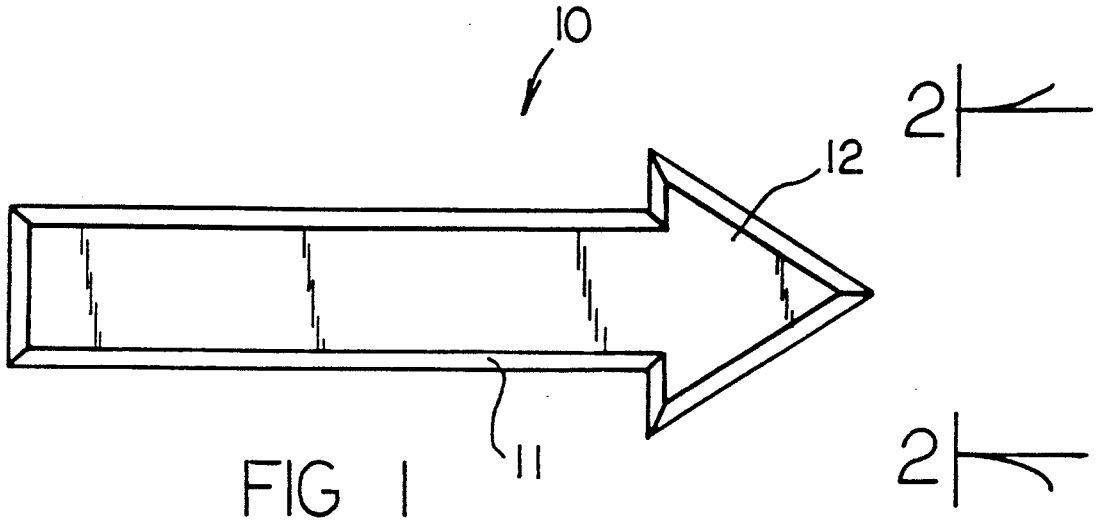
FIG. 1 is an orthographic top view of the instant invention.
Figure 2:
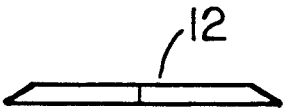
FIG. 2 is an orthographic view, taken along the lines 2—2 of FIG. 1 in the direction indicated by the arrows.

With reference now to the drawings, and in particular to FIGS. 1 to 10 thereof, a new and improved traffic control marker apparatus embodying the principles and concepts of the present invention and generally designated by the reference numerals 10, 10*a*, and 10*b* will be described.

More specifically, the traffic control marker apparatus 10 of the instant invention essentially comprises a linearly elongated and aligned body 11 mounting an arrow head 12 at a forward distal end thereof formed of a flexible, polymeric material for positioning upon a top of a roadway 29 (see FIG. 10 for example) to route traffic about a repair site 30 utilizing conventional traffic cones 31 and the like.

Figure 3:
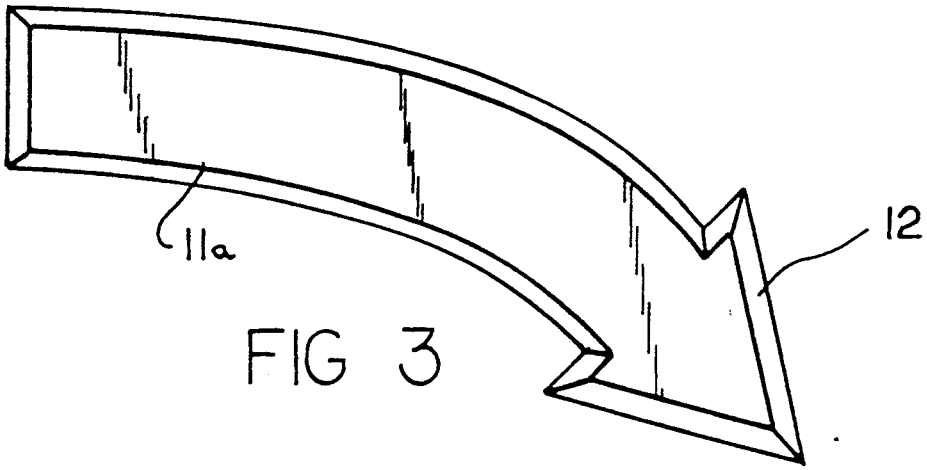
FIG. 3 is an orthographic top view of the invention illustrating an arcuate marker body.
Figure 4:
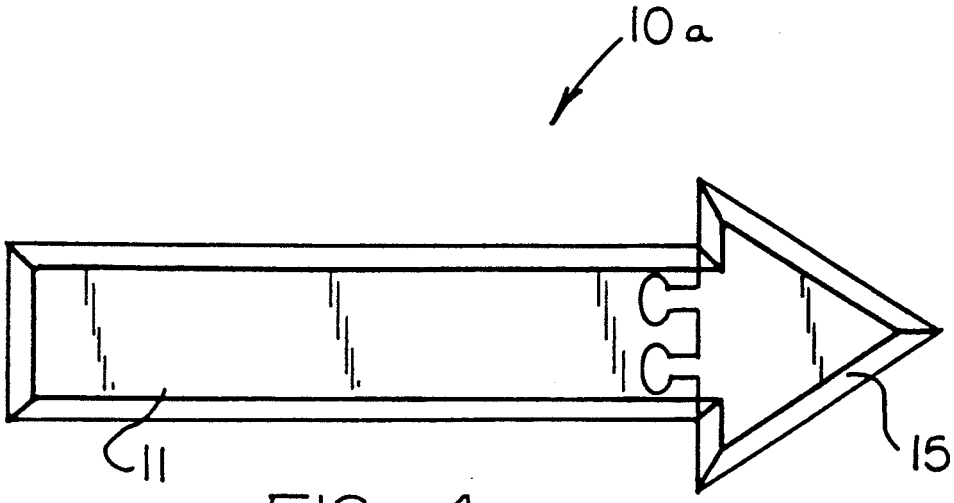
FIG. 4 is an orthographic top view of a modified aspect of the invention utilizing a removable head.
Figure 5:
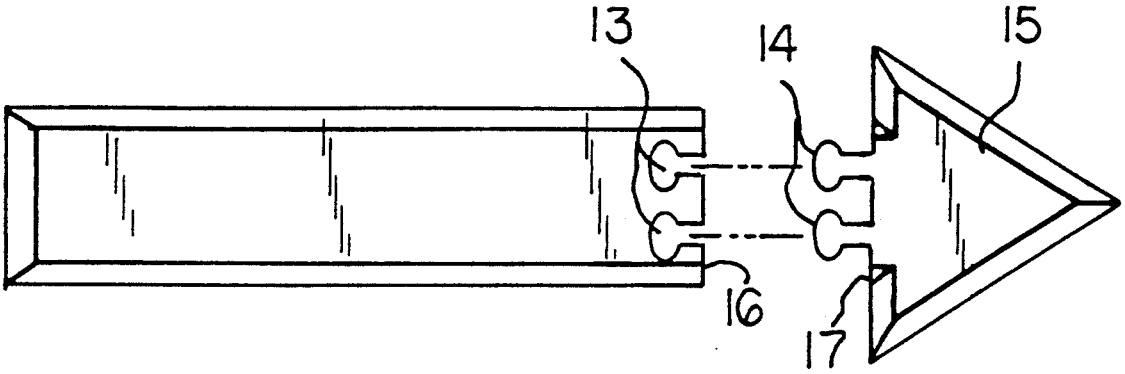
FIG. 5 is an orthographic top view of the invention, as illustrated in FIG. 4, illustrating the head in a separate orientation relative to the body.
Figure 6:
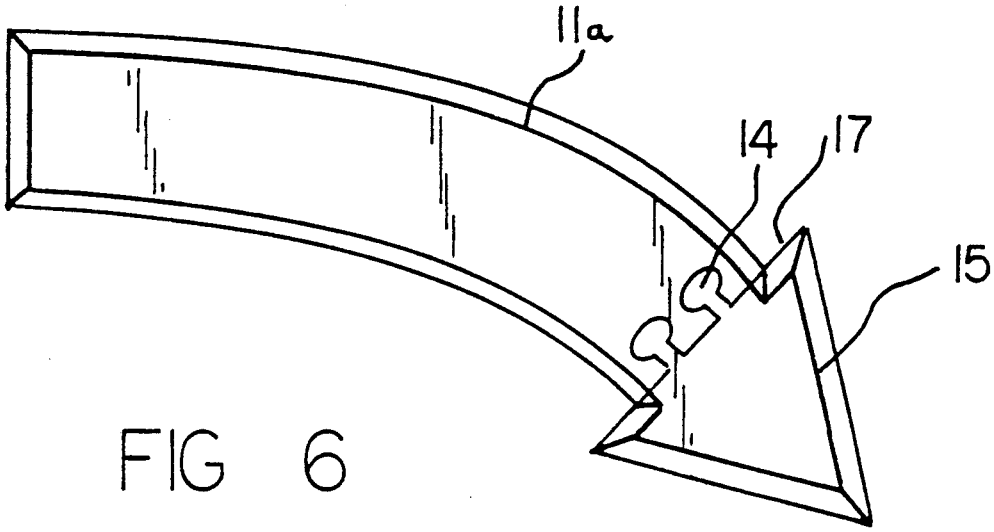
FIG. 6 is an orthographic top view of the removable head structure relative to an arcuate body.

The FIGS. 4 and 5 illustrate the use of the apparatus 10*a*, wherein the forward distal end of the body 11 includes "T" shaped slots 13 complementarily receiving "T" shaped projections 14 formed to the arrow rear edge 17, with the slots 13 projecting through the planar body forward edge 16 for contiguous communication of the forward edge 16 and the arrow rear edge 17 in use. The modified bodies 11*a*, as illustrated in FIG. 6, as well as in FIG. 3, are set forth to illustrate the use of an arcuate body as required.

Figure 7:
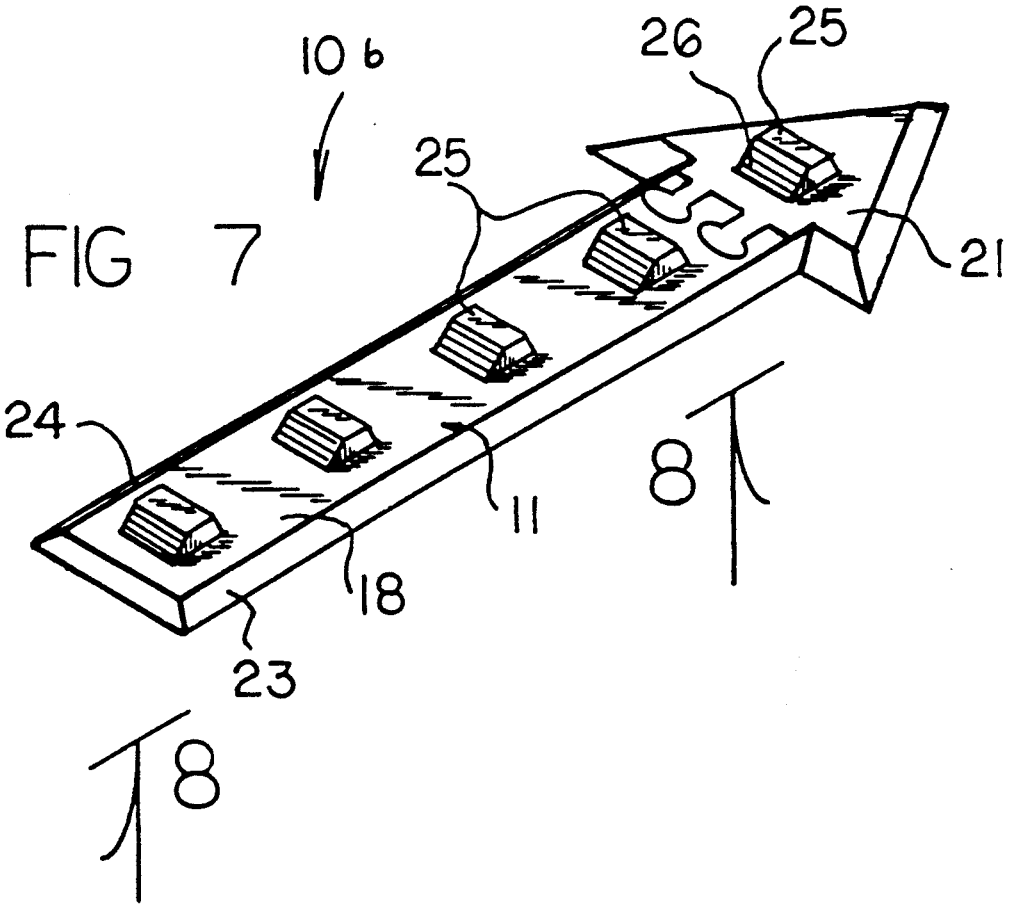
FIG. 7 is an isometric illustration of a modification of the invention.
Figure 8:
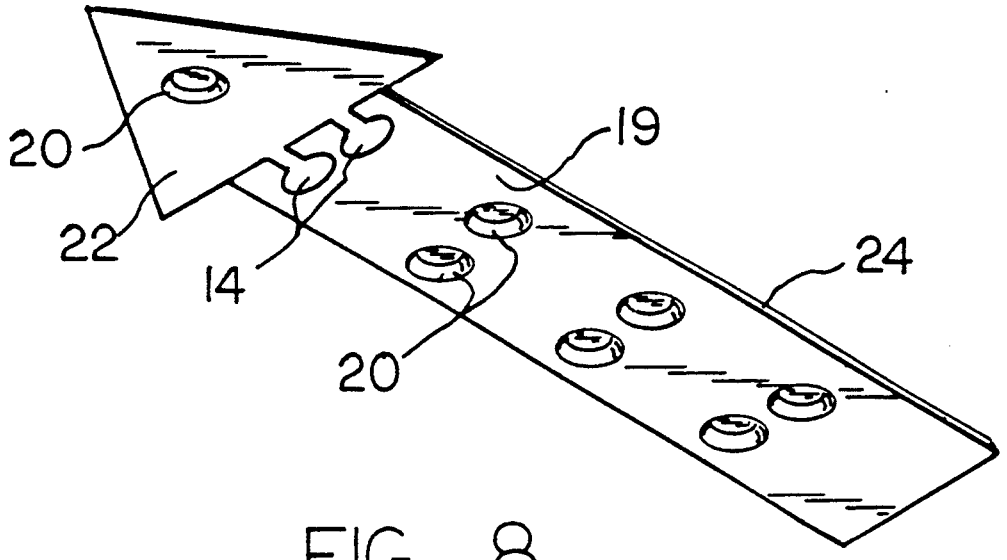
FIG. 8 is an orthographic view, taken along the lines 8—8 of FIG. 7 in the direction indicated by the arrows.

The apparatus 10*b*, as illustrated in FIGS. 7 and 8 for example, illustrates the use of the body top wall 18 arranged parallel to the bottom wall 19, with the top wall 18 mounting a plurality of linearly aligned and equally spaced reflector projections 25, including a reflector lens 26 mounted to each projection, with the lens 26 of each projection 25 arranged in a parallel relationship and oriented towards a rear distal of the body 11. The projections 25 are positioned medially of the respective body first and second side walls 23 and 24. A body and associated lens is also arranged for mounting medially of the arrow head body, and more specifically mounted to the arrow head top wall 21. The arrow head bottom wall 22, as well as the body bottom wall 19, include suction cup members 20 molded for positioning therewithin. The suction cup members are arranged for use in travel conditions apart from roadways, such as interiorly of buildings in the directing of traffic within a building such as in a warehouse and the like accommodating vehicles.

Figure 9:
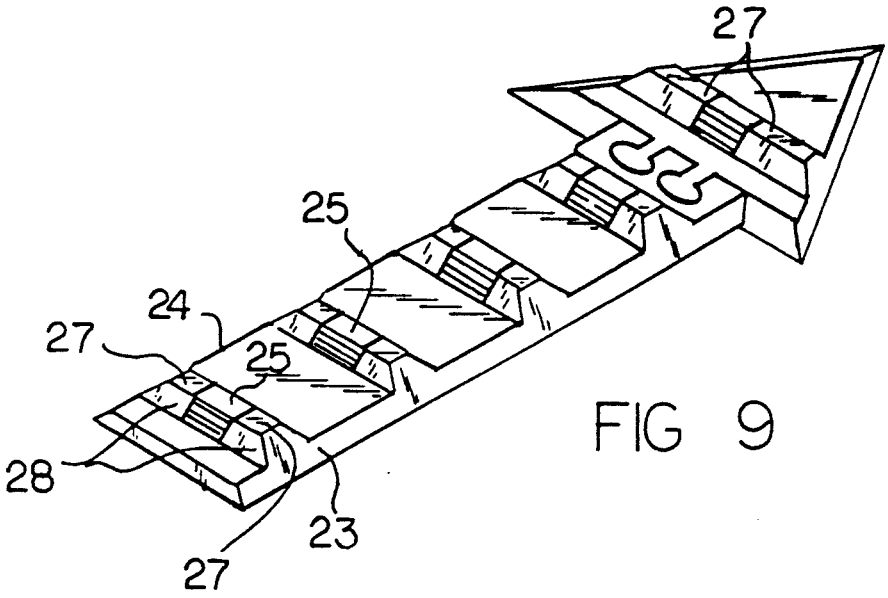
FIG. 9 is an isometric illustration of the aspect of the invention as set forth in FIG. 7 utilizing traffic bump members in association with the reflector housings.
Figure 10:
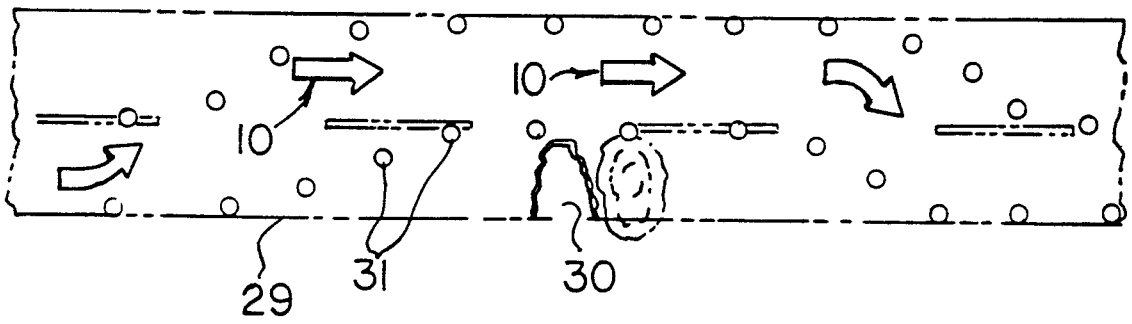
FIG. 10 is an orthographic top view of the invention in use.

The FIG. 9 illustrates the organization further utilizing rigid boss member pairs 27 mounted to opposed sides of each of the reflector projections 25, wherein the projections 25 and the boss member pairs 27 are aligned relative to one another, and each boss member pair and medially positioned reflector projection 25 is arranged in a parallel equally spaced relationship relative to an adjacent boss member pair 27 and reflective projection 25. Further, each boss member 27 and medially positioned reflector projection 25 are orthogonally oriented relative to the body first and second side walls 23 and 24. The rigid boss member pairs 27 afford projection to the reflector projections 25, as well as providing for a speed bump to apprise drivers of caution relative to a roadway 29.

It should be noted that there is a tapered periphery 15 of the bodies 11, 11*a*, 12, and 12*a* to enhance engagement of the structure to an underlying road surface.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A traffic control marker apparatus, comprising, an elongate body, the elongate body including a planar body forward edge, a body first side wall spaced from a body second side wall, a body top wall and a body bottom wall, and an arrow head body mounted to the planar body forward edge, the arrow head body including an arrow head body rear edge in contiguous communication with the planar body forward edge, and the arrow head body and the planar body formed of a flexible polymeric material, and the forward edge includes a plurality of spaced "T" shaped* slots projecting from the body top wall to the body bottom wall, and the slots spaced apart a predetermined spacing, and the arrow body rear edge including a plurality of spaced "T" shaped* projections, the "T" shaped projections fixedly and integrally mounted to the arrow body rear edge spaced apart the predetermined spacing and complementarily mounted within the slots, and a plurality of suction cup members positioned within the body bottom wall, and at least one suction cup member positioned within the arrow head body bottom wall, and a plurality of reflector projections fixedly mounted to the body top wall medially of the body first side wall and the body second side wall, wherein the reflector projections are spaced apart a further spacing, and the arrow head body including an arrow head body top wall, and the arrow head body top wall including a further reflector projection mounted to the arrow head body top wall, and each reflector projection including a reflector lens mounted to a forward surface of each reflector projection, and each lens is arranged in a parallel relationship relative to one another and oriented towards a rear edge of the elongate body, and each reflector projection includes a plurality of rigid boss members mounted on opposed sides of each reflector projection, and each reflector projection and each pair of associated rigid boss members are arranged in a linearly aligned relationship extending orthogonally between the body first side wall and the body second side wall, and each forward surface of each rigid boss member includes a canted front wall oriented in a coplanar relationship relative to the reflector lens of the reflector projection positioned between the boss member pair.

* * * * *